US011060826B1

(12) United States Patent
Croom et al.

(10) Patent No.: US 11,060,826 B1
(45) Date of Patent: Jul. 13, 2021

(54) TELESCOPIC-WIDTH MINE ROLLER

(71) Applicant: United States of America as represented by the Secretary of the Navy, Arlington, VA (US)

(72) Inventors: Jeremy Croom, Panama City Beach, FL (US); Dustin Bride, Panama City Beach, FL (US); Daniel Coats, Panama City Beach, FL (US); Patrick Delay, Panama City Beach, FL (US); Bobbi Wood, Panama City Beach, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/887,723

(22) Filed: May 29, 2020

(51) Int. Cl.
*F41H 11/30* (2011.01)

(52) U.S. Cl.
CPC ..... *F41H 11/30* (2013.01)

(58) Field of Classification Search
CPC ..... F41H 11/30; F41H 11/16; F41H 11/13; F41H 11/12
USPC ..... 89/1.13
See application file for complete search history.

(56) References Cited

U.S. PATENT DOCUMENTS 5,313,868 A * 5/1994 Wolf ..... F41H 11/30 102/402
5,685,554 A * 11/1997 Poxleitner ..... B60D 1/167 280/491.2
5,853,187 A * 12/1998 Maier ..... B60D 1/485 280/495
6,915,728 B2 * 7/2005 Renwick ..... F41H 11/30 102/402
7,040,645 B1 * 5/2006 Borneman ..... B60D 1/485 280/491.5
7,806,197 B2 * 10/2010 Steinlage ..... A01B 33/021 172/176
7,938,431 B1 * 5/2011 Snyder ..... B60D 1/586 280/494
8,397,612 B2 * 3/2013 Koplin ..... A01B 29/04 89/1.13
9,303,957 B2 * 4/2016 Cronk ..... F41H 11/30
9,557,146 B2 * 1/2017 Bradley ..... F41H 11/24
2008/0236376 A1 * 10/2008 Reeves ..... F41H 11/28 89/1.13
2011/0048217 A1 * 3/2011 Ulrich ..... F41H 11/30 89/1.13
2011/0180283 A1 * 7/2011 Koplin ..... F41H 11/30 172/547
2011/0296976 A1 * 12/2011 Simula ..... F41H 11/30 89/1.13

(Continued)

*Primary Examiner* — Joshua E Freeman
(74) *Attorney, Agent, or Firm* — James T. Shepherd

(57) ABSTRACT

A mine roller includes a bracket having a first end and a second end. The first end is adapted to be coupled to a vehicle. A table having a center region is coupled to the second end of the bracket for rotation about the second end in a first plane. The table has first and second telescopic portions coupled to the center region such that the table is extendable relative to the center region in opposing directions of a second plane that is perpendicular to the first plane. A roller bank is coupled to each telescopic portion of the table for rotation relative to the respective telescopic portion in a third plane that is parallel to the second plane.

16 Claims, 4 Drawing Sheets

(56) References Cited

U.S. PATENT DOCUMENTS

| | | | | |
|---|---|---|---|---|
| 2013/0327203 | A1* | 12/2013 | Cronk | F41H 11/30<br>89/1.13 |
| 2015/0362295 | A1* | 12/2015 | Bradley | F41H 11/24<br>89/1.13 |
| 2018/0080746 | A1* | 3/2018 | Cronk | F41H 7/02 |

* cited by examiner

TELESCOPIC-WIDTH MINE ROLLER

ORIGIN OF THE INVENTION

The invention described herein may be manufactured and used by or for the Government of the United States of America for Governmental purposes without payment of any royalties.

FIELD OF THE INVENTION

The invention relates generally to mine rollers, and more particularly to a mine roller whose width can be adjusted for purposes of transportation and application.

BACKGROUND OF THE INVENTION

Mine rollers are used to trigger "pressure plate improvised explosive devices" (PP-IEDs). In general, PP-IEDs consist of a pressure-induced switch, an explosive charge, and a pair of conductive paths to form an electrical circuit between the switch and charge. Downward pressure closes the switch and completes the electrical path to thereby detonate the charge. Mine rollers are devices that are used to trigger PP-IEDs from a standoff distance. Mine rollers are pushed in front of combat vehicles and generate large downward forces to initiate detonation of a PP-IED on the receiving end of such downward forces. Current mine roller systems have solid, heavy frames that cannot be adjusted to accommodate various combat vehicle platforms or to meet transportation/storage requirements.

SUMMARY OF THE INVENTION

Accordingly, it is an object of the present invention to provide a mine roller that can be adjusted in size to accommodate a variety of vehicle sizes.

Another object of the present invention is to provide a mine roller that can be adjusted in size to facilitate transportation or storage requirements.

Other objects and advantages of the present invention will become more obvious hereinafter in the specification and drawings.

In accordance with the present invention, a mine roller includes a bracket having a first end and a second end. The first end is adapted to be coupled to a vehicle. A table having a center region is coupled to the second end of the bracket for rotation about the second end in a first plane. The table has a first telescopic portion and a second telescopic portion coupled to the center region such that the table is extendable relative to the center region in opposing directions of a second plane that is perpendicular to the first plane. A first roller bank is coupled to the first telescopic portion for extension therewith parallel to the second plane and for rotation relative to the first telescopic portion in a third plane that is parallel to the second plane. Similarly, a second roller bank is coupled to the second telescopic portion for extension therewith parallel to the second plane and for rotation relative to the second telescopic portion in the third plane.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
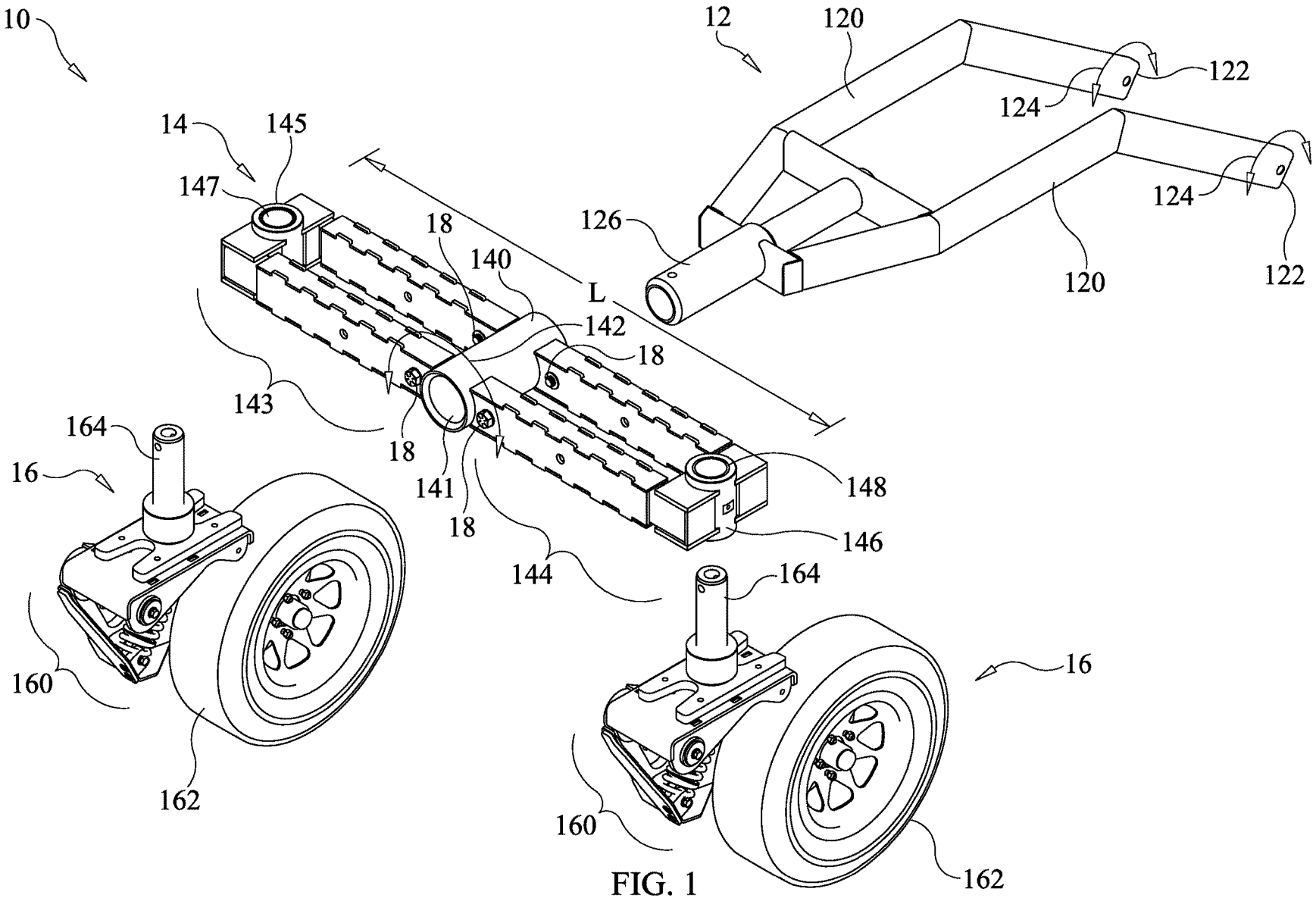
FIG. 1 is an exploded perspective view of a telescopic-width mine roller in accordance with an embodiment of the present invention.
Figure 2:
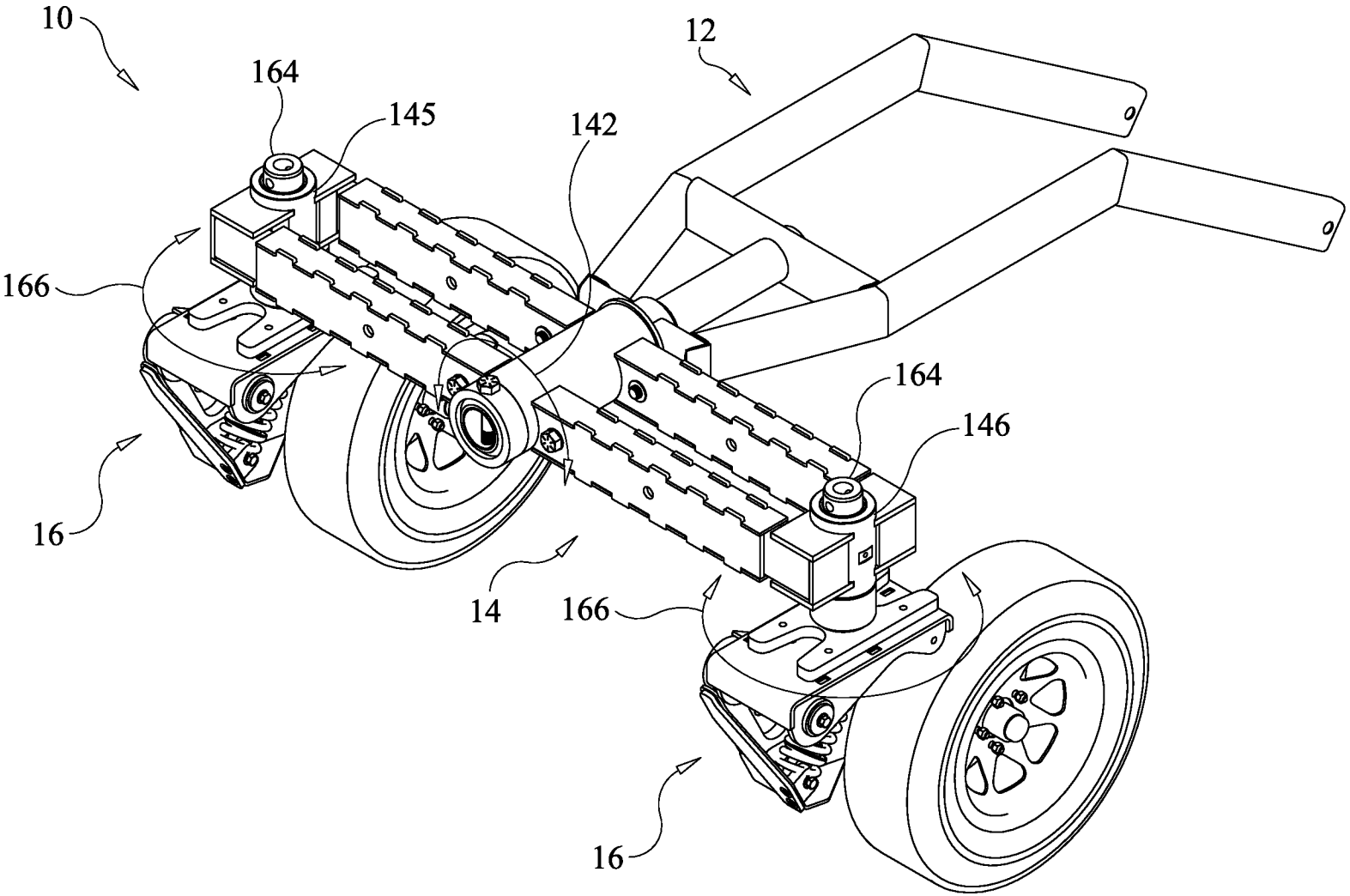
FIG. 2 is a perspective view of the fully-assembled mine roller illustrated in FIG. 1.

Referring now to the drawings, simultaneous reference will be made to FIGS. 1 and 2 where a telescopic-width mine roller in accordance with an embodiment of the present invention is shown and is referenced generally by numeral 10. Mine roller 10 is configured to be coupled to the front portion of a small vehicle (not shown), the choice of which is not a limitation of the present invention.

Mine roller 10 includes a bracket 12 attachable on one end thereof to a vehicle, a telescopic table 14, and two single-wheel roller assemblies or banks 16. Bracket 12 is a rigid structure having, for example, two arms 120 at one end thereof whose outboard ends 122 are configured to be coupled to a vehicle such that bracket 12 can pivot about ends 122 as indicated by rotational arrows 124. The other end of bracket 12 terminates in a cylindrical mounting rod 126 used to couple bracket 12 to telescopic table 14 as will be explained further below.

Telescoping table 14 is, in general, a telescoping assembly that defines a rigid structure when configured to a desired length "L". In the illustrated embodiment, telescoping table 14 has a center mount 140 configured to cooperate with mounting rod 126 of bracket 12. Mount 140 includes a cylindrical bushing 141 that is engaged by mounting rod 126 such that telescoping table 14 can rotate in a plane of rotation indicated by rotation arrow 142. Rod 126 can be retained within mount 140 in any of a variety of ways well-known in the art (e.g., by use of a cotter pin or other transverse pin, end cap, etc.) without departing from the scope of the present invention.

Figure 3:
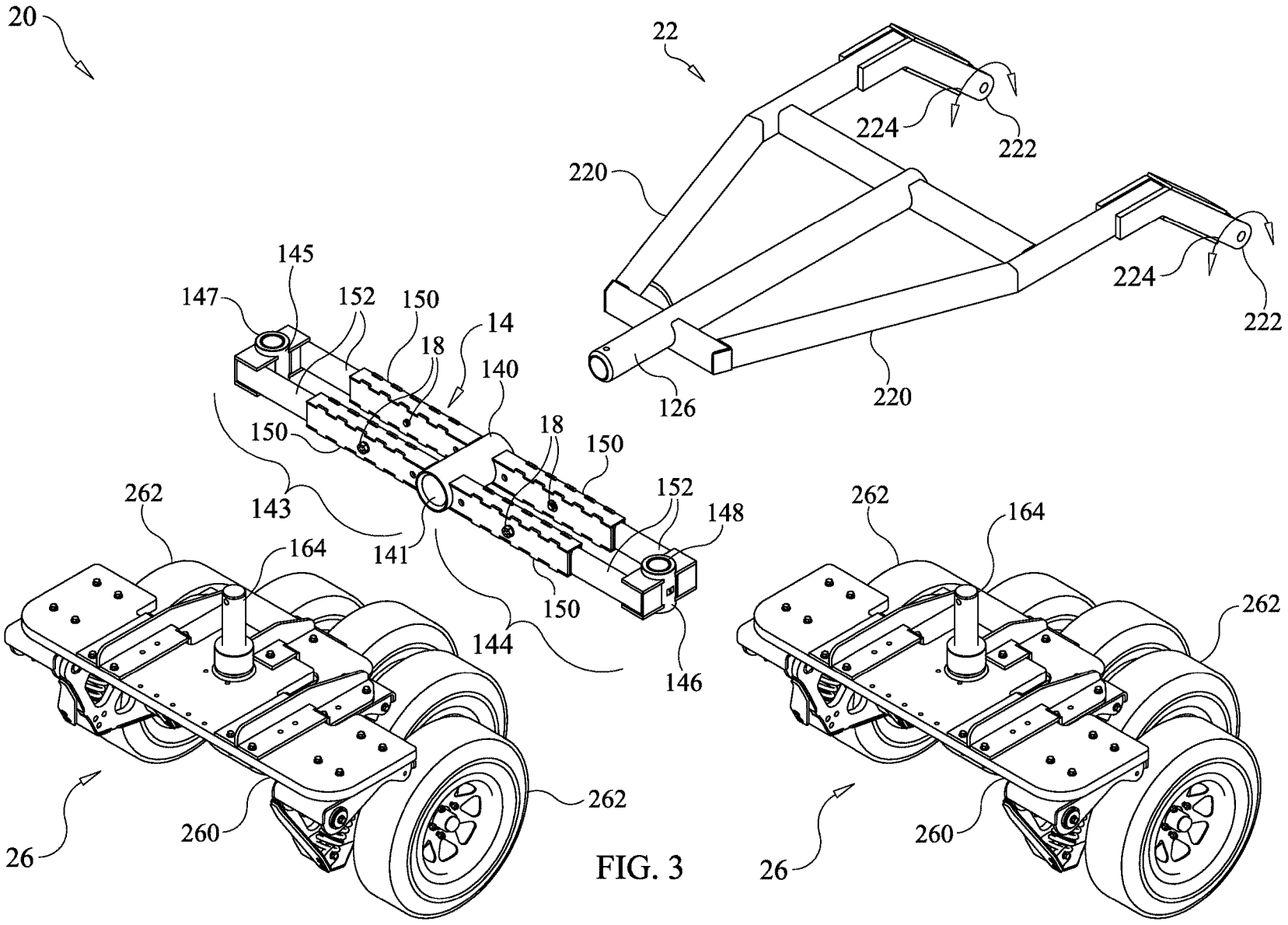
FIG. 3 is an exploded perspective view of a telescopic-width mine roller in accordance with another embodiment of the present invention.
Figure 4:
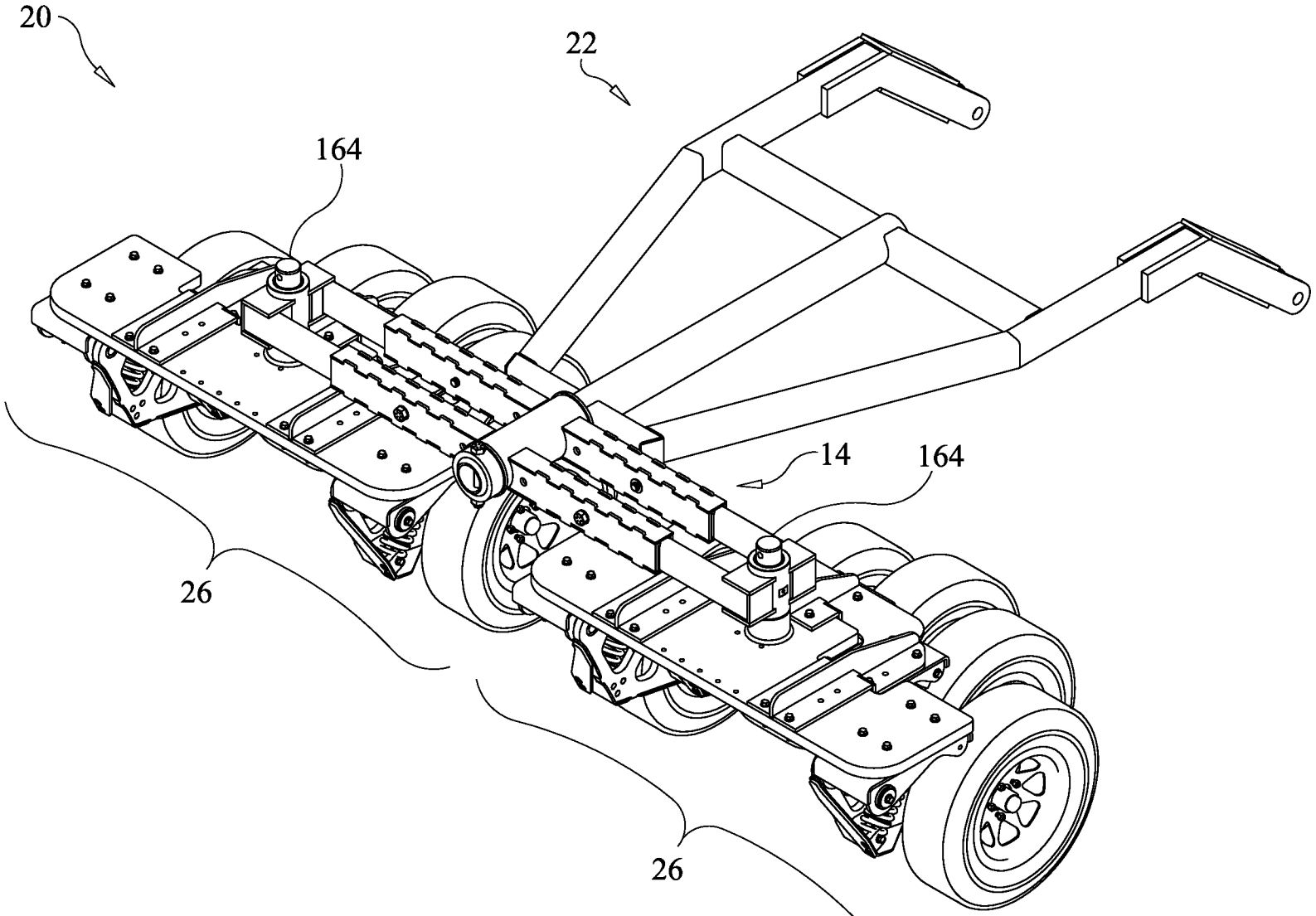
FIG. 4 is a perspective view of the fully-assembled mine roller illustrated in FIG. 3.

Rigidly coupled to and extending from center mount 140 are two telescopic table portions 143 and 144. Each of telescopic table portions 143 and 144 is extendable relative to center mount 140. More specifically, telescopic table portions 143 and 144 can extend in opposing directions and in a plane that is perpendicular to the plane of the table's rotation indicated by rotational arrow 142. In this embodiment, table portions 143 and 144 are positioned and locked in their narrowest width position by bolts 18. The structure of table portions 143 and 144 that supports a wider width table will be described below with reference to FIGS. 3 and 4. Table portions 143 and 144 have outboard ends that terminate in a rotation-supporting mount 145 and 146, respectively. Mounts 145 and 146 include respective cylindrical bushings 147 and 148 to support rotation of roller banks 16 as will be explained further below.

Each roller bank 16 includes a wheel suspension structure 160, a wheel 162 coupled to suspension structure 160, and a cylindrical post 164 coupled to and extending up from suspension structure 160. In general, wheel 162 defines the point of engagement with a ground surface (not shown)

when mine roller 10 is coupled to a vehicle. A variety of constructions can be used for suspension structure 160 and wheel 162 without departing from the scope of the present invention. Cylindrical post 164 is sized and positioned for rotational engagement with one of bushings 147 and 148 located in associated mounts 145 and 146, respectively, as illustrated in FIG. 2. In this way, each roller bank is free to rotate in 360° in a plane that is perpendicular to the plane of rotation 142 and parallel to the plane of table 14 as indicated by rotational arrows 166 in FIG. 2. Each cylindrical post 164 can be retained within its mount 145 or 146 in a variety of ways known in the art without departing from the scope of the present invention.

As mentioned above, telescopic table portions 143 and 144 are extendable relative to center mount 140 to change the width of table 14. The structure of table portions 143 and 144 that provide this function are more clearly shown in the embodiment illustrated in FIGS. 3 and 4 where a wider width mine roller is referenced generally by numeral 20. Mine roller 20 includes a bracket 22 attachable on one end thereof to a vehicle, telescoping table 14, and two multi-wheel roller assemblies or banks 26. Bracket 22, analogous to the above-described bracket 12, has arms 220 terminating in ends 222 configured to be coupled to a vehicle such that bracket 22 can pivot about ends 222 as indicated by rotational arrows 224. Bracket 22 terminates at its other end in the above-described cylindrical mounting rod 126.

The details of each table portion 143 and 144 are identical such that only a description of table portion 143 will be provided herein. Table portion 143 includes rigid open-ended tubes 150 coupled to center mount 140 and extending away therefrom. Indexed to and slidingly engaged within tubes 150 are corresponding legs 152. The above-described mounts 145 and 146 are coupled to the outer ends of legs 152. When legs 152 are extended out from tubes 150 to a desired position, bolts 18 are used to lock legs 152 to tubes 150 via corresponding aligned holes in the tubes 150 and legs 152. While the illustrated embodiment only shows two sets of holes in each pair of tubes 150, it should be noted that any number of holes may be utilized in tubes 150 and/or legs 152 to select and fix a desired position of legs 152. To maximize the strength of table portions 143 and 144, tubes 150 and legs 152 have rectangular cross sections.

Each roller bank 26 includes a wheel suspension structure 260, multiple wheels 262 coupled to suspension structure 260, and a cylindrical post 164 extending up from suspension structure 260 for rotational engagement with one of mounts 145 and 146 as described above.

The advantages of the present invention are numerous. The telescopic table is readily adapted in width to accommodate a variety of roller banks. The mine roller is readily broken down for ease of storage and transportation, and is readily assembled just prior to use. The telescopic table supports multi-dimensional movements that allow the mine roller to adapt to uneven surfaces while remaining in contact therewith to assure full ground engagement during a mine rolling application.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A mine roller, comprising:

a bracket having a first end and a second end, said first end adapted to be coupled to a vehicle;

a table having a center region rotatably coupled to said second end of said bracket for rotation about said second end in a first plane, wherein said second end extends perpendicular to said first plane said table having a first telescopic portion and a second telescopic portion coupled to said center region and extendable relative to said center region in opposing directions of a second plane that is perpendicular to said first plane;

a first roller bank rotatably coupled to said first telescopic portion for extension therewith parallel to said second plane and for rotation relative to said first telescopic portion in a third plane that is parallel to said second plane; and a second roller bank rotatably coupled to said second telescopic portion for extension therewith parallel to said second plane and for rotation relative to said second telescopic portion in said third plane.

2. A mine roller as in claim 1, wherein said second end of said bracket is cylindrical, and wherein said center region of said table comprises a cylindrical bushing adapted to engage said second end of said bracket.

3. A mine roller as in claim 1, wherein said first roller bank includes a cylindrical post, and wherein said first telescopic portion includes a cylindrical bushing for rotational engagement with said cylindrical post of said first roller bank.

4. A mine roller as in claim 3, wherein said second roller bank includes a cylindrical post, and wherein said second telescopic portion includes a cylindrical bushing for rotational engagement with said cylindrical post of said second roller bank.

5. A mine roller as in claim 1, wherein each of said first roller bank and said second roller bank includes at least one wheel adapted to engage a ground surface when said bracket is coupled to a vehicle.

6. A mine roller, comprising:

a bracket having a first end and a second end, said first end adapted to be coupled to a vehicle;

a table having a center region rotatably coupled to said second end of said bracket for rotation about said second end in a first plane, wherein said second end extends perpendicular to said first plane first tubes rigidly coupled to said center region and extending therefrom in a first direction, second tubes rigidly coupled to said center region and extending therefrom along a second direction in direct opposition to said first direction, first legs for sliding engagement with said first tubes and for rigid coupling thereto at a first selected position, and second legs for sliding engagement with said second tubes and for rigid coupling thereto at a second selected position;

a first roller bank rotatably coupled to said first legs for rotation in a second plane that is perpendicular to said first plane; and a second roller bank rotatably coupled to said second legs for rotation in said second plane.

7. A mine roller as in claim 6, wherein said second end of said bracket is cylindrical, and wherein said center region of said table comprises a cylindrical bushing adapted to engage said second end of said bracket.

8. A mine roller as in claim 6, further comprising a first mount having a cylindrical bushing, wherein said first mount is coupled to the outer ends of said first legs, and wherein said first roller bank includes a cylindrical post for rotational engagement with said cylindrical bushing of said first mount.

9. A mine roller as in claim 8, further comprising a second mount having a cylindrical bushing, wherein said second mount is coupled to the outer ends of said second legs, and wherein said second roller bank includes a cylindrical post for rotational engagement with said cylindrical bushing of said second mount.

10. A mine roller as in claim 6, wherein each of said first roller bank and said second roller bank includes at least one wheel adapted to engage a ground surface when said bracket is coupled to a vehicle.

11. A mine roller, comprising:

a bracket having a first end and a second end, said first end adapted to be coupled to a vehicle;

a table having a center region rotatably coupled to said second end of said bracket for rotation about said second end in a first plane, wherein said second end extends perpendicular to said first plane first rectangular tubes rigidly coupled to said center region and extending therefrom in a first direction, second rectangular tubes rigidly coupled to said center region and extending therefrom along a second direction in direct opposition to said first direction, first rectangular legs in sliding engagement with said first rectangular tubes, and second rectangular legs in sliding engagement with said second rectangular tubes;

a first roller bank rotatably coupled to said first rectangular legs for rotation in a second plane that is perpendicular to said first plane; and a second roller bank rotatably coupled to said second rectangular legs for rotation in said second plane.

12. A mine roller as in claim 11, wherein said second end of said bracket is cylindrical, and wherein said center region of said table comprises a cylindrical bushing adapted to rotationally engage said second end of said bracket.

13. A mine roller as in claim 11, further comprising a first mount having a cylindrical bushing, wherein said first mount is coupled to the outer ends of said first legs, and wherein said first roller bank includes a cylindrical post for rotational engagement with said cylindrical bushing of said first mount.

14. A mine roller as in claim 13, further comprising a second mount having a cylindrical bushing, wherein said second mount is coupled to the outer ends of said second legs, and wherein said second roller bank includes a cylindrical post for rotational engagement with said cylindrical bushing of said second mount.

15. A mine roller as in claim 11, wherein each of said first roller bank and said second roller bank includes at least one wheel adapted to engage a ground surface when said bracket is coupled to a vehicle.

16. A mine roller as in claim 11, further comprising means for rigidly coupling said first rectangular legs to said first rectangular tubes at a first selected position, and means for rigidly coupling said second rectangular legs to said second rectangular tubes at a second selected position.

* * * * *